United States Patent [19]

Rothfuss et al.

[11] Patent Number: 5,056,762

[45] Date of Patent: Oct. 15, 1991

[54] APPARATUS FOR MOUNTING A GAS WASHING SINK IN A CENTERED MANNER IN A PERFORATED BRICK

[75] Inventors: Hans Rothfuss, Taunusstein; Raimund Brückner, Engenhahn-Niedernhausen; Peter Keutgen, Kreuzau; Josef Seeger, Düren; Manfred Winkelmann, Krefeld; Herbert Metzger, Duisburg, all of Fed. Rep. of Germany

[73] Assignee: Didier-Werke AG, Wiesbaden, Fed. Rep. of Germany

[21] Appl. No.: 573,057

[22] Filed: Aug. 23, 1990

Related U.S. Application Data

[63] Continuation of Ser. No. 413,673, Sep. 28, 1989.

[30] Foreign Application Priority Data

Oct. 1, 1988 [DE] Fed. Rep. of Germany ..... 3833504

[51] Int. Cl.[5] ..... C21C 5/48

[52] U.S. Cl. ..... 266/217; 266/265

[58] Field of Search ..... 266/217, 218, 220, 236, 266/288, 265; 222/603

[56] References Cited

U.S. PATENT DOCUMENTS

| | | | |
|---|---|---|---|
| 4,589,635 | 5/1986 | Reichard et al. | 266/220 |
| 4,779,849 | 10/1988 | Rothfuss et al. | 266/270 |
| 4,802,655 | 2/1989 | Bates | 266/218 |

FOREIGN PATENT DOCUMENTS

| | | |
|---|---|---|
| 105868 | 4/1984 | European Pat. Off. . |
| 137961 | 4/1985 | European Pat. Off. . |
| 181853 | 5/1986 | European Pat. Off. . |
| 1268793 | 5/1968 | Fed. Rep. of Germany . |
| 1608036 | 12/1970 | Fed. Rep. of Germany . |
| 3240097 | 12/1970 | Fed. Rep. of Germany . |
| 3316459 | 11/1984 | Fed. Rep. of Germany . |
| 3538498 | 5/1987 | Fed. Rep. of Germany . |
| 3623609 | 1/1988 | Fed. Rep. of Germany . |
| 3716920 | 12/1988 | Fed. Rep. of Germany . |
| 88/06191 | 8/1988 | World Int. Prop. O. . |

*Primary Examiner*—S. Kastler

*Attorney, Agent, or Firm*—Wenderoth, Lind & Ponack

[57] ABSTRACT

An apparatus for mounting a gas washing sink in a centered manner within an opening through a perforated brick in a wall of a metallurgical vessel and for removing the sink from the perforated brick includes a support assembly to be fixedly mounted on the exterior of the wall of the metallurgical vessel adjacent the opening in the perforated brick. A fastening assembly supports the sink and is mounted with respect to the support assembly for movement relative thereto between an operating position, whereat the sink is pressed into the opening throgh the perforated brick in a centered manner, and a maintenance position, whereat the sink is withdrawn from the opening through the perforated brick. Structure moves the fastening assembly relative to the support assembly to the operating position. A withdrawal apparatus moves the fastening assembly relative to the support assembly from the operating position to the maintenance position.

16 Claims, 5 Drawing Sheets

FIG. 1
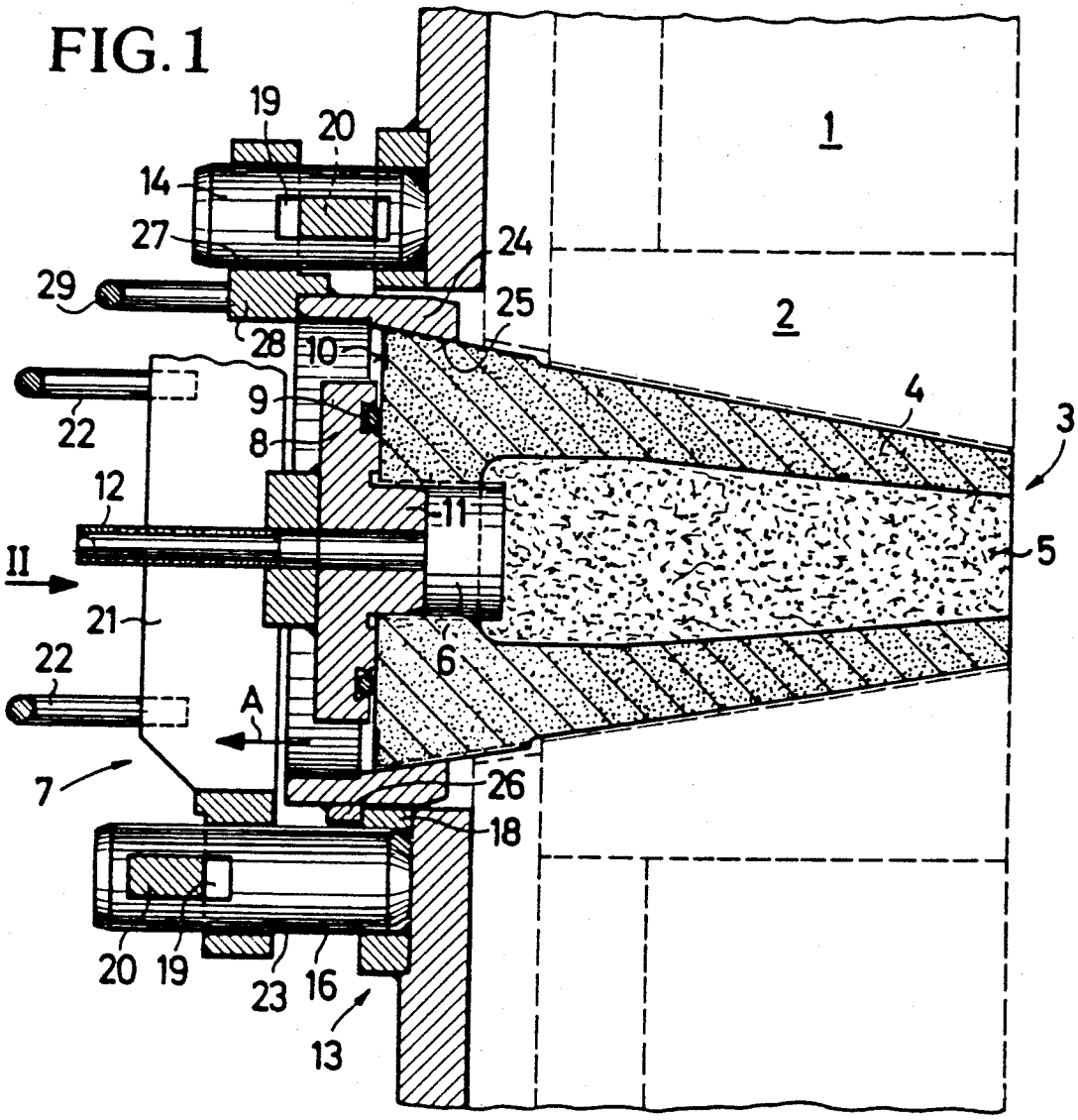
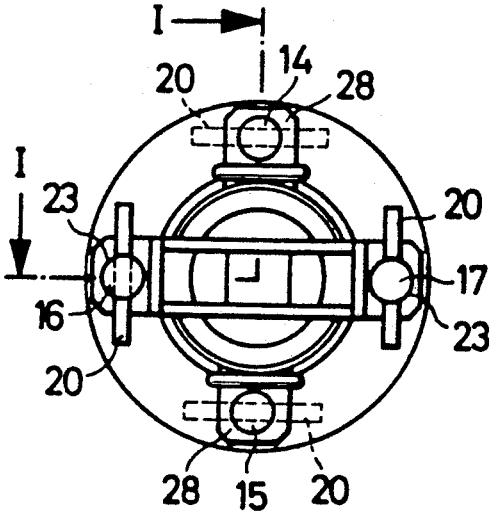
FIG. 2

APPARATUS FOR MOUNTING A GAS WASHING SINK IN A CENTERED MANNER IN A PERFORATED BRICK

This is a continuation application of Ser. No. 07/413,673, filed Sept. 28, 1989.

BACKGROUND OF THE INVENTION

The present invention relates to an apparatus for mounting a gas purging, flushing or washing stone or sink in a centered manner within an opening through a perforated brick in a wall of a metallurgical vessel, to enable gas to be introduced through the sink into molten metal within the metallurgical vessel, during which gas introduction operation the sink becomes worn and eroded, and for removing the worn or eroded sink from the perforated brick. More particularly, the present invention is directed to such an apparatus including a support assembly to be mounted on the exterior of the outer wall of the metallurgical vessel and a fastening assembly movable with respect to the support assembly to push against or urge the sink inwardly into the opening in the perforated brick.

A device of this general type is disclosed in the prospectus "DIDIER, Gasspülsysteme, Betriebsanleitung, 3.84, pages 5 to 7". In this known arrangement the fastening-supporting assembly basically is formed by a bayonet connection and lock that, via shims, holds the gas washing sink within the perforated brick. The fastening device does not operate to center the gas washing sink within the perforated brick. To withdraw a worn sink from the perforated brick, a withdrawal device separate from the fastening-supporting assembly is used. Such withdrawal device is attached to a gas inlet connection for leading gas to the gas washing sink after the bayonet connection or lock has been opened. A withdrawal device of this general type is disclosed in European EP 0 137 961.

SUMMARY OF THE INVENTION

With the above discussion in mind, it is an object of the present invention to provide an improved apparatus for mounting a gas washing sink in a perforated brick in a wall of a metallurgical vessel and for removing the sink from the perforated brick, whereby it is possible to overcome disadvantages of the above and other known arrangements.

It is a further object of the present invention to provide such an apparatus whereby the apparatus itself ensures centering of the gas washing sink within the opening of the perforated brick.

It is a further, more specific object of the present invention to provide such an apparatus which is operable not only for mounting the gas washing sink within the perforated brick, but also is operable for removing or withdrawing the gas washing sink from the perforated brick.

These objects are achieved in accordance with the present invention by the provision of an apparatus including a support assembly to be fixedly mounted on the exterior of the wall of the metallurgical vessel adjacent the opening in the perforated brick, and fastening means for supporting the sink and mounted with respect to the support assembly for movement relative thereto between an operating position, whereat the sink is pressed into the opening through the perforated brick in a centered manner, and a maintenance or open position, whereat the sink is withdrawn from the opening through the perforated brick and is positioned outwardly thereof. Means, operable between the support assembly and the fastening means, moves the fastening means relative to the support assembly to the operating position. Withdrawal means, operable between the support assembly and the fastening means, moves the fastening means relative to the support assembly from the operating position to the maintenance position. The apparatus of the present invention having the above construction provides the advantageous feature that the mounting, centering and removal or withdrawal functions all are achieved by a single assembly or integrated apparatus. As a result, installation and dismantling of the gas washing sink is simplified, and this simplification facilitates and accelerates maintenance operations involving the metallurgical vessel.

In accordance with a further feature of the present invention, the fastening means includes a closure member to be positioned in a sealed manner against the gas washing sink and having a gas inlet connection for delivery of gas into the gas washing sink. As a result, the function of delivery of gas to the gas washing sink also is integrated into the apparatus of the present invention. However, the apparatus of the present invention has the significant advantage that the gas inlet connection, contrary to the prior art, is not permanently connected to or part of the gas washing sink, but rather is connected to the fastening means or assembly of the apparatus of the present invention. During use of the apparatus of the present invention and introduction of gas into the gas washing sink, the closure member achieves the function of sealing of the outward end of a gas distribution chamber provided in the gas washing sink. As a result, it is not necessary to provide the gas washing sink with a conventional metal sheath or casing, and such metal sheath therefore can be simplified or completely eliminated by use of the apparatus of the present invention.

When the gas washing sink is in the maintenance position, it need only be removed from the closure member and replaced by a new gas washing sink. The gas inlet connection and the member that closes the outward end of the gas distribution chamber of the gas washing sink, i.e. the closure member, can be reused as a component of the fastening assembly of the apparatus of the present invention and does not have to be replaced with the gas washing sink. This provides a significant economical advantage over known arrangements.

BRIEF DESCRIPTION OF THE DRAWINGS

Other objects, features and advantages of the present in will be apparent from the following detailed description of preferred embodiments thereof, with references to accompanying drawings, wherein:

FIG. 1 is a longitudinal sectional view through one embodiment of the apparatus of the present invention, shown in a position mounting and centering a gas washing sink within a perforated brick of a wall of a metallurgical vessel, and generally taken along line I—I of FIG. 2;

FIG. 2 is an elevation view taken in the direction of arrow II in FIG. 1;

DETAILED DESCRIPTION OF THE INVENTION

Figure 3:
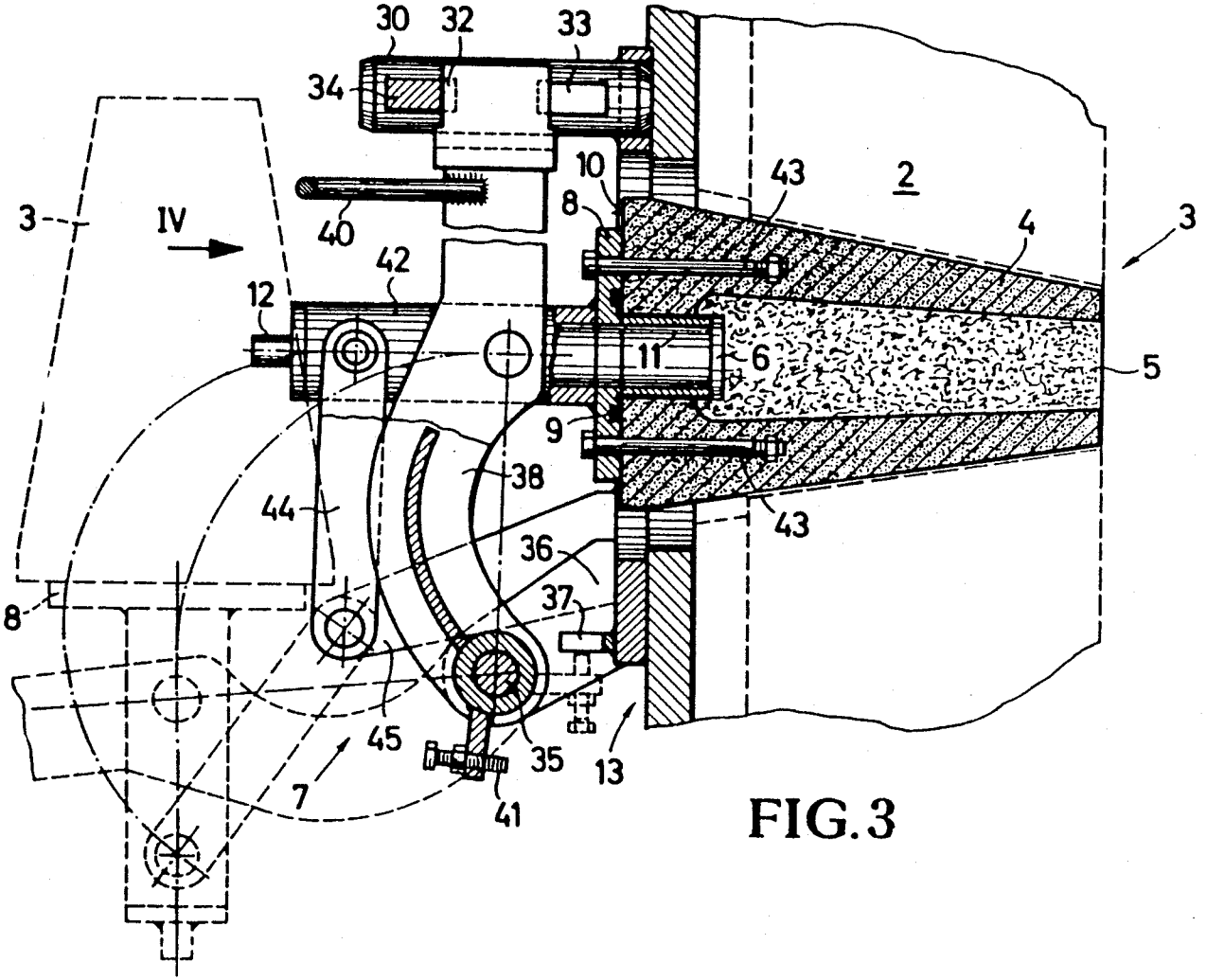
FIG. 3 is a view similar to FIG. 1, but of another embodiment of the present invention, and also indicating in dashed lines a maintenance position of the gas washing sink.
Figure 5:
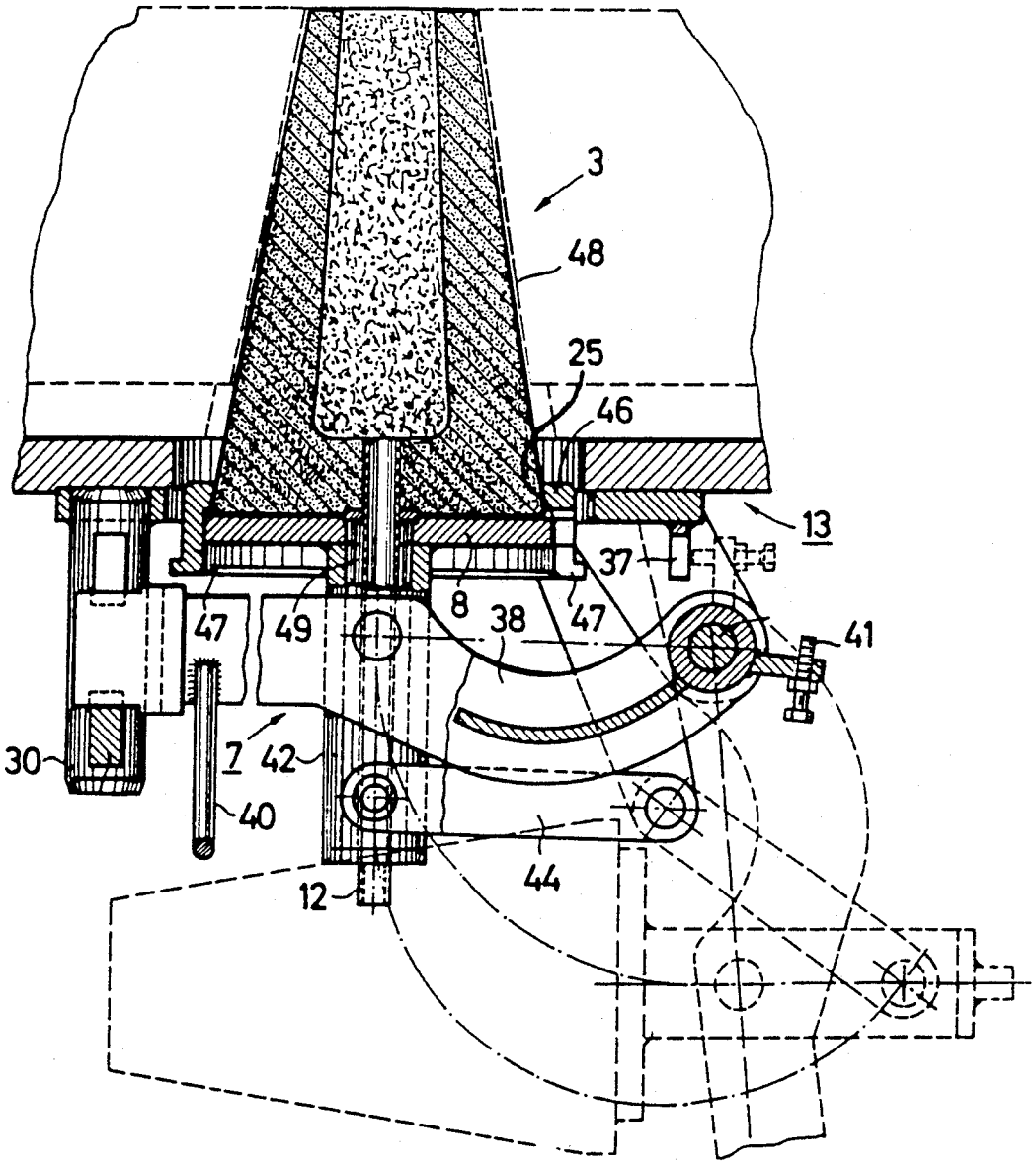
FIG. 5 is a view similar to FIG. 3, but indicating a modification thereof.

A metallurgical vessel to contain molten metal includes a floor 1. FIGS. 1, 3 and 5 indicate the metallurgical vessel being in a tilted position in which floor 1 is approximately vertical. The floor or wall 1 includes a perforated brick 2 having therethrough an opening, for example conical as illustrated. Positioned within the opening in perforated brick 2 is a gas washing sink 3 having a conical exterior. In the illustrated arrangement, gas washing sink 3 includes a gas impermeable refractory outer portion 4 and a gas permeable refractory inner portion 5, and a cylindrical gas distribution chamber 6 open to inner portion 5 and to an outer end of outer portion 4. This illustrated gas washing sink in and of itself does not form the present invention, but rather is the invention disclosed in a concurrently filed application entitled "GAS WASHING SINK WITHOUT INTEGRAL CLOSURE MEMBER", assigned to the assignee of the present application (Ref: 59/PA3799), the disclosure of which is incorporated herein by reference. It is to be understood that the apparatus of the present invention also is applicable to other types of gas washing sinks, for example previously known gas washing sinks.

Gas washing sink 3 is mounted within perforated brick 2, centered therein and withdrawn therefrom by means of an apparatus in accordance with the present invention.

More particularly, in the embodiment shown in FIGS. 1 and 2, the apparatus includes a support assembly 13 to be fixedly mounted on the exterior of the wall of the metallurgical vessel adjacent the opening in perforated brick 2. Support assembly 13 includes four rods or columns 14–17 (FIG. 2) fixed to the exterior of the wall of the vessel and extending therefrom in parallel directions. Stops 18, only one of which is visible in FIG. 1, are positioned adjacent the columns. Columns 14–17 have extending therethrough cross-slots 19 of equal size for receipt therein of wedges 20, to be discussed in more detail below.

The apparatus of the present invention further includes fastening means 7 for supporting sink 3 and mounted with respect to support assembly 13 for movement relative thereto between an operating position (shown in FIG. 1), whereat the sink is pressed into the opening through perforated brick 2 in a centered manner, and a maintenance position (not shown in FIG. 1) whereat sink 3 is withdrawn from and positioned outwardly of the opening in perforated brick 2. In the embodiment of FIGS. 1 and 2, fastening means 7 includes a cross member 21 having at opposite ends thereof bores 23 extending therethrough, with columns 16 and 17 extending through bores 23, such that cross member 21 is slidable along columns 16 and 17 in opposite directions. Cross member 21 supports a closure member 8 having a sealing ring 9 abutting sealing surface 10 on the outer end of gas washing sink 3. A projection 11 of closure member 8 projects into gas distribution chamber 6. In place of sealing ring 9, a sealing sleeve could be inserted into the gas distribution chamber 6 and squeezed by a projection 11 to form a seal. Connected to closure member 8 is a gas inlet connection pipe 12 that supplies gas through projection 11 into gas distribution chamber 6. Cross member 21 is provided with handles 22.

Fastening means 7 further includes a centering ring 24 having a contact surface 25 complementary to the outer conical periphery of sink 3. Centering ring 24 has brackets 28 having therethrough bores 27 through which extend columns 14 and 15, such that centering ring 24 is slidable along columns 14, 15 in opposite directions. Centering ring 24 is provided with handles 29. FIG. 1 illustrates contact surface 25 in direct contact with the refractory material of the sink 3. However, this portion of the outer periphery of sink 3 could be provided with a metal jacket to absorb forces exerted on sink 3 by surface 25 in a manner that will be apparent from the discussion below.

Columns 14–17 and the connection of closure member 8 to cross member 21, as well as the connection of centering ring 24 are provided at locations such that the sink 3 held by centering ring 24 is centered with respect to the opening through perforated brick 2. One skilled in the art readily would understand how to so position these elements to achieve centering, from the disclosure herein.

The apparatus of FIGS. 1 and 2 operates in the following manner. Thus, the apparatus is illustrated therein in the operating position. Wedges 20 are driven into cross slots 19 of pins 16 and 17. Thus, cross member 21 and closure member 8 are forced tightly toward surface 10 of sink 3, thereby creating a seal by means of seal ring 9. Movement of sink 3 inwardly moves centering ring 24 inwardly, but this movement is limited by abutment of projections 26 of centering ring 24 with stops 18 of the support assembly 13. Thus, the outer periphery of sink 3 is pressed tightly against contact surface 25. Gas then can be introduced into sink 3 by gas inlet connection pipe 12.

During the gas inlet operation, the inner end of sink 3 becomes worn and eroded and thus periodically must be replaced. When this is to be achieved, wedges 20 are driven out of slots 19 of columns 16, 17. The operator then can remove cross member 21, closure member 8 and gas inlet connection pipe 12 by means of handles 22. Then, wedges 20 are driven into cross-slots 19 of pins 14 and 15. This is shown in the upper portion of FIG. 1 and is shown by dashed lines in FIG. 2. Centering ring 24 thereby is moved in the direction of arrow A in FIG. 1, and contact of surface 25 with the outer surface of sink 3 pulls sink 3 out of the perforated brick 2. Centering ring 24 and sink 3 then can be pulled off of columns 14, 15 by means of handles 29. The worn sink 3 then can be removed from centering ring 24 and a new sink 3 installed therein. Mounting of centering ring 24 over columns 14 and 15 then centers the new sink 3 within the opening in perforated brick 2. Before sink 3 is pushed into brick 2 the exterior surface of sink 3 may have applied thereto a layer of refractory mortar, and this mortar will not become stripped off since the sink 3 enters the opening in brick 2 in a completely centered manner. Thereafter, cross member 21 and closure member 8 are mounted over columns 16 and 17, and projection 11 enters chamber 6 of the new sink 3. Alternatively, cross member 21 may be mounted on columns 16 and 17 simultaneously with the mounting of centering ring 24 on columns 14 and 15. Thus, cross member 21 and centering ring 24 can be detachably connected to be manipulated together via a connection, not shown. In any case, wedges 20 then are driven into cross-slots 19 of columns 16 and 17 to return to the operating position illustrated in FIG. 1.

In the above arrangement, wedges 20 operate between support assembly 13 and fastening means 7 to move fastening means 7 relative to support assembly 13 to the operating position shown in FIG. 1, wedges 20 then being driven into cross-slots 19 of columns 16 and 17. Wedges 20 also operate as withdrawal means, operable between support assembly 13 and fastening means 7 for moving fastening means 7 relative to support assembly 13 from the operating position shown in FIG. 1 to the maintenance position. Thus, when wedges 20 are driven into cross-slots 19 in columns 14 and 15, the fastening means 7 is moved outwardly relative to support assembly 13.

Figure 4:
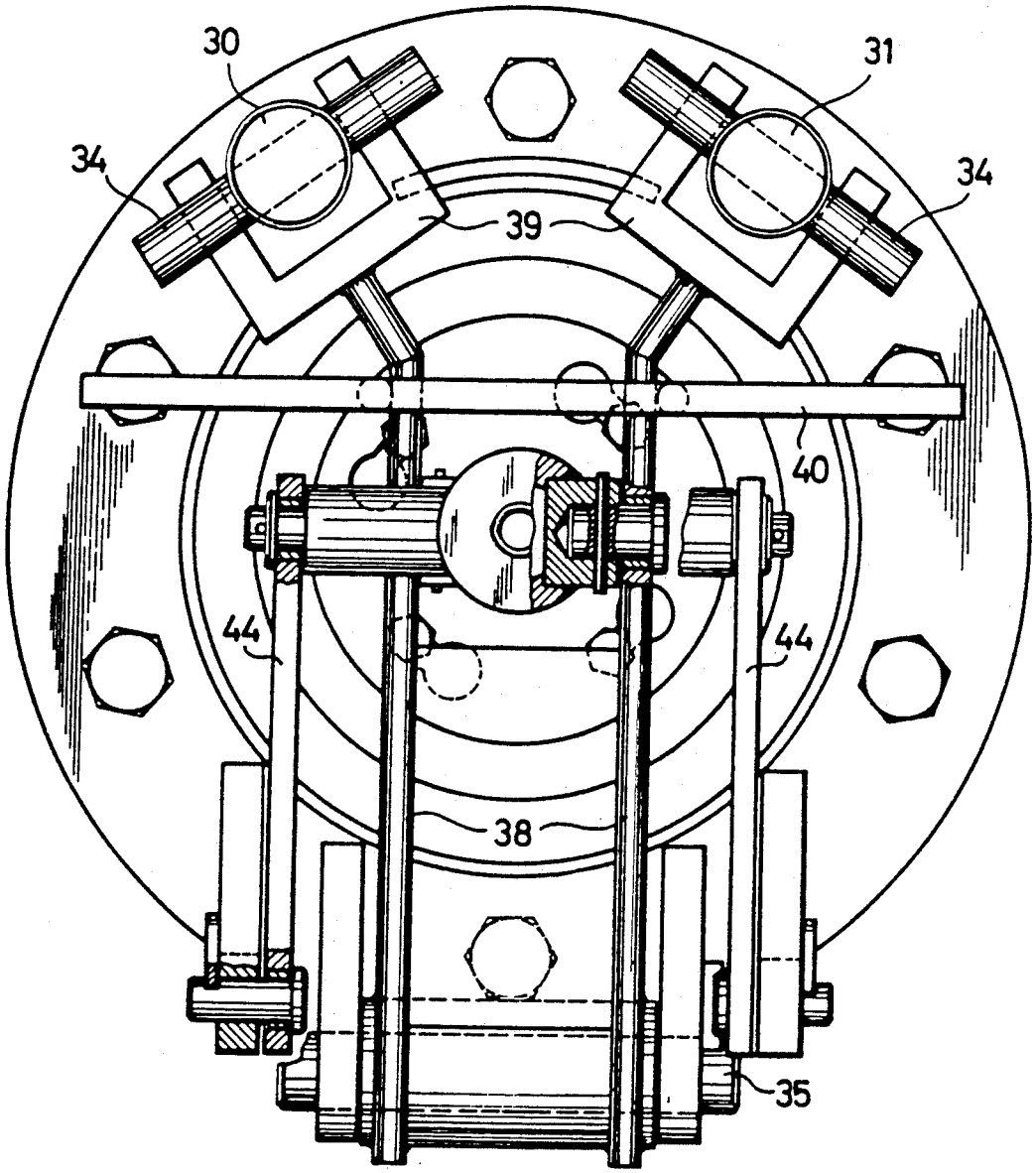
FIG. 4 is an elevation view, on an enlarged scale, taken in the direction of arrow IV in FIG. 3.

In the embodiment of FIGS. 3 and 4 the support assembly includes two columns 30, 31 and also a pivot axis 35 on a bracket or brackets 36. The support assembly also includes another pivot axis on a bracket or brackets 45, as well as a stop 37, to be discussed in more detail below.

The fastening means 7 of the embodiment of FIGS. 3 and 4 includes a lever assembly pivotable about axis 35 and including a pair of lever arms 38 each of which is pivoted at a first end thereof about axis 35. The other end of each of levers 35 has a substantially U-shaped member 39 that embraces and is movable relative to a respective column 30 or 31. A handle 40 is connected to levers 38, and also connected thereto is a member supporting an adjustable abutment member 41 for contacting stop 37 to limit the extent of pivoting of levers 38 about axis 35, as shown in dashed lines in FIG. 3.

A tubular member 42 is connected to levers 38 and supports closure member 8 with projection 11 thereof extending into chamber 6 of sink 3. In this embodiment closure member 8 is connected to sink 3, for example by means of removable bolt assemblies 43. Seal ring 9 of closure member 8 thus is tightly sealed against surface 10 of sink 3. The lever assembly also includes levers 44 pivotable about the other axis on bracket or brackets 45 and connected to tubular member 42. The construction of the lever assembly including levers 38, 44 is constructed in a quadrangular or kinomatic manner, as readily would be understood by one skilled in the art from the present disclosure, to achieve a particular pattern of movement from the operating position (shown in solid lines in FIG. 3) to the maintenance position (shown in dashed lines in FIG. 3). Thus, the movement from the operating position to the maintenance position of sink 3 is achieved firstly in a direction essentially vertically to the plane of the opening in perforated brick 2, and the movement of sink 3 then is pivotable over a curved path at an angle of approximately 90° to the maintenance position. Columns 30, 31 each have formed therein a pair of axially spaced slots 32, 33.

The embodiment of FIGS. 3 and 4 operates in the following manner. Thus, in the operating position shown in solid lines in FIG. 3, wedges 34 are driven into slots 32 in columns 30 and 31. Wedges 34 operate in this capacity as the moving means of the present invention. Sink 3, centered on closure member 8, is thus supported and pressed into the opening in perforated brick 2 in a centered manner. When sink 3 has become worn, wedges 34 are removed from cross-slots 32 and then are driven into cross-slots 33 in the columns 30 and 31. In this manner, the lever assembly, closure member 8 and sink 3 are moved outwardly such that sink 3 is detached from perforated brick 2. By means of handle 40, the lever assembly then is moved from the solid line operating position to the dashed line maintenance position shown in FIG. 3 during which sink 3 first moves in a substantially or essentially linear path vertically of the plane of the opening in the perforated brick and then in a curved path until member 41 abuts stop 37. Wedges 34 thus operate as the withdrawal means of the present invention. In the maintenance position shown by dashed lines in FIG. 3 the sink 3 readily is accessible and can be removed from closure member 8. A new sink 3 then is mounted on closure member 8, and the assembly then is pivoted from the maintenance position to the operating position whereby the new sink will be precisely centered in the opening in perforated brick 2. Wedges 34 then again are driven into cross-slots 32 of columns 30 and 31, such that the sink 3 is pressed into the perforated brick 2 in a centered manner.

FIG. 5 illustrates a modification of the embodiment of FIGS. 3 and 4. The pivoting movement of the fastening means 7 is the same. However, sink 3 is not connected to closure member 8 by means of the bolt assemblies 43 of FIG. 3, but rather is connected thereto by means of a centering ring 46 that is connected to closure member 8. Centering ring 46 of FIG. 5 is different from the centering ring 24 of the embodiment of FIG. 1 in that centering ring 46 is not itself fastened to the support assembly 13. Rather, centering ring 46 includes a shoulder 47 that encloses closure member 8, and shoulder 47 and closure member 8 are designed to be connected by a rotary motion, for example in a manner as would be achieved by a conventional bayonet fastener, well known in the art. More particularly, centering ring 46 is rotated relative to closure member 8 about the longitudinal axis of sink 3 and thus is connected to closure member 8, with contact surface 25 of centering ring 46 holding the sink 3 against closure member 8 in a centered manner. Pivoting movement from the maintenance position (shown in dashed lines in FIG. 5) to the operating position (shown in solid lines in FIG. 5) thereby will ensure centering of sink 3 within the opening in the perforated brick. Thus, in this embodiment the contact surface 25 of centering ring 46 maintains sink 3 centered at its conical perimeter and fastened at such centered orientation to closure member 8.

In the illustration of FIG. 5 a commercially available or conventional sink 3 is shown. Such sink includes an outer jacket or shell 48 and a gas supply pipe 49 connected to the sink. Pipe 49 projects through tubular member 42. In such an arrangement a seal between the closure member 8 and sink 3 would not be necessary. It is to be understood however that the embodiment of FIG. 5 equally is applicable to the type of sink illustrated in FIGS. 1 and 3. If the embodiment of FIG. 5 were employed with a sink such as shown in FIGS. 1 and 3, then tubular member 42 would have at the outer end thereof a flap-type closure member or valve 57 (see FIG. 6) having a gas inlet connection 12 attached thereto. When the sink of FIG. 5 is used, then flap 57 would be opened to allow pipe 49 to extend therethrough. When a sink as shown in FIGS. 1 and 3 is used, flap 12 would be closed to allow gas to be supplied through gas inlet connection 12.

If the sink 3 is provided, at least at the portion thereof contacted by contact surface 25 of centering ring 24 of 46, with a metal jacket or shell, then it also would be possible to provide that such shell perform the function of centering ring 24 or 46, as would be understood by one skilled in the art.

Figure 6:
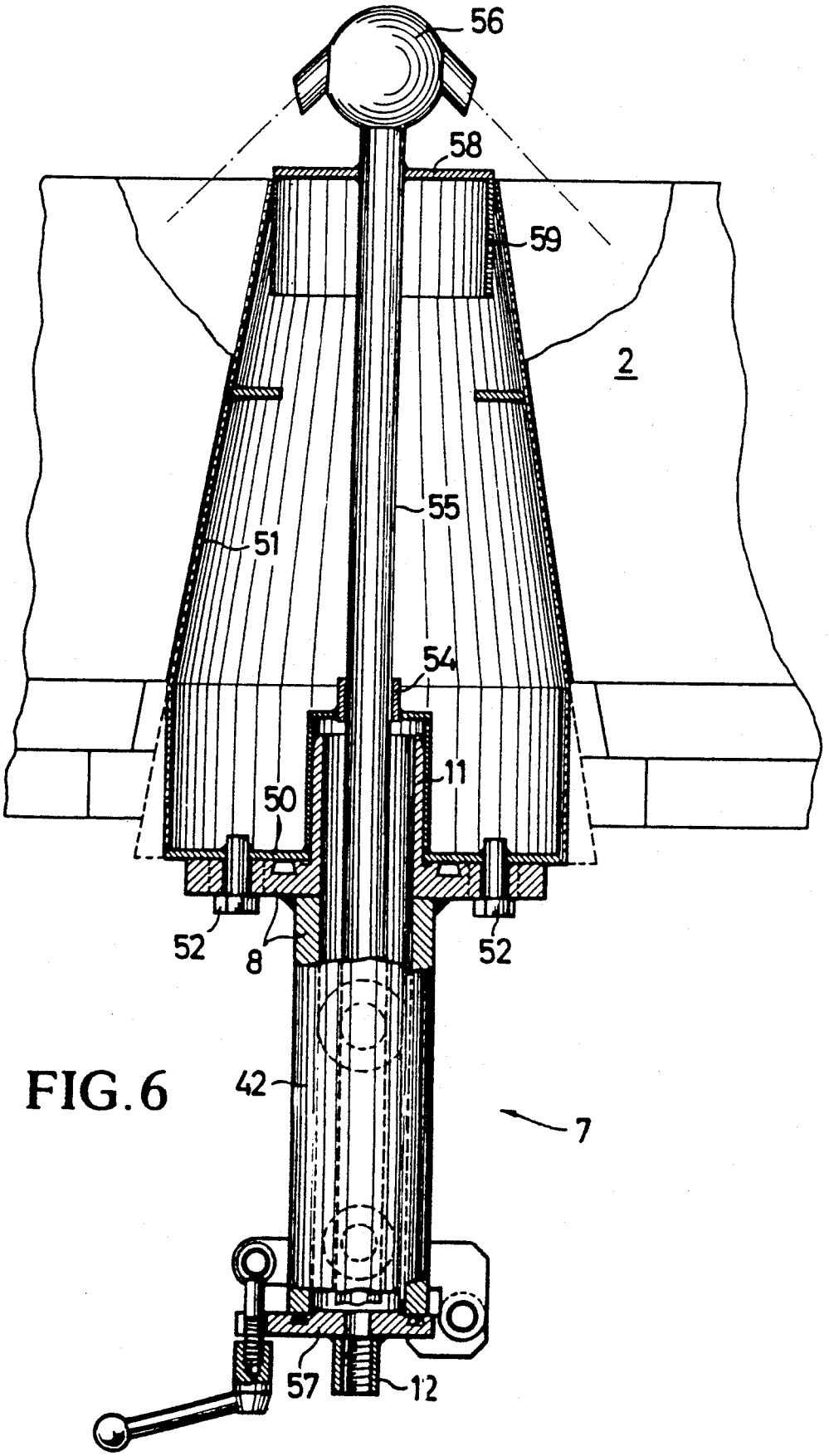
FIG. 6 is a longitudinal sectional view illustrating a portion of the apparatus of the present invention employable with a template usable for the repair of a worn portion of a perforated brick of the wall of the metallurgical vessel.

FIG. 6 illustrates a further use that might be made of the apparatus of the present invention. Thus, during use, eventually the inner end of the perforated brick 2 also becomes eroded or worn, as shown in FIG. 6. When such erosion occurs, then it generally is necessary to repair the perforated brick 2, since replacement is extremely difficult and expensive. The apparatus of the present invention can be employed with a repair apparatus illustrated in FIG. 6 to achieve this operation. The repair apparatus in and of itself does not form the present invention, but rather is the invention of a concurrently filed application entitled "APPARATUS FOR REPAIRING A PERFORATED BRICK IN A METALLURGICAL VESSEL", assigned to the assignee of the present application (Ref: 59/PA3811), the disclosure of which is incorporated herein by reference. FIG. 6 illustrates only a portion of the apparatus of the present invention adapted to such repair apparatus, and specifically a portion of the embodiment of FIGS. 3 and 5. More particularly, FIG. 6 shows only closure member 8, tubular member 42, flap 57 and gas inlet connection 12. The other elements of the apparatus of the present invention are not illustrated in FIG. 6, since they are not essential for understanding of the manner of use of the present invention with the repair apparatus shown in FIG. 6.

Thus, the repair apparatus includes a casing 51 having a bottom 50 removably attached to closure member 8, for example by bolts 52. Casing 51 has an outer contour corresponding to the outer contour of the sink 3, and when casing 51 thus is inserted into the worn perforated brick 2, in a centered manner by the apparatus of the present invention, the outer contour of casing 51 forms a template defining the contour of the opening in the worn portion of perforated brick 2. A repair material supply pipe 55 extends through tubular member 42 and is guided by a sleeve 54 of casing 51. An inner end of pipe 55 has a spray or distribution head 56 that directs repair material toward the worn area of the perforated brick 2. A plate 58 having a skirt 59 is attached to pipe 55 to protect against repair material entering the interior of casing 51. Pipe 55 can be rotated about the axis of sleeve 54 and also moved along such axis, and during such movement repair material that is supplied through pipe 55 and head 56 repairs the worn area of the brick 2.

This aspect of the present invention is operated in the following manner. Thus, when a worn sink 3 is removed from the worn perforated brick 2, for example by operation of the apparatus of the present invention in the manners described above, then casing 51 is attached to closure member 8, and the apparatus of the present invention is operated in the above described manner to insert casing 51 in a centered manner into the opening in the worn perforated brick 2. The pipe 55 extends through the casing, and repair material (and possibly also compressed air) are supplied through pipe 55 and head 56 to repair the perforated brick. When the repair material has set, then the casing 51 is removed from the opening in the repaired perforated brick 2, by operation of the apparatus of the present invention in the above described manners. The casing 51 is removed from closure member 8, a new sink 3 is connected thereto, and then the apparatus of the present invention is operated to insert such new sink 3 into the opening in the repaired perforated brick 2.

The apparatus of the present invention also can employ the repair structure shown in FIG. 6 for not only selected repair of a worn perforated brick 2, but also for constructing the refractory brick lining of the metallurgical vessel to ensure that the perforated brick is correctly positioned therein. In such case, before the vessel is lined, casing 51, without pipe 55, is fastened to closure member 8 and pivoted by the apparatus of the present invention into the vessel. A new perforated brick 2 then is positioned over casing 51. It thus is possible to guarantee from the beginning of the construction of the lining of the vessel that the perforated brick 2 is correctly aligned with respect to support assembly 13 arranged on the exterior of the wall of the vessel. Casing 15 does not have to be reusable but rather can be designed as a disposable element.

As will be apparent from the above description, the apparatus of the present invention ensures centered installation of a perforated brick, centered insertion of a gas washing sink into a perforated brick, and centered repair of a worn perforated brick.

Although the present invention has been described and illustrated with respect to preferred features thereof, it is to be understood that various changes and modifications may be made to the specifically described and illustrated features without departing from the scope of the present invention.

We claim:

1. An apparatus for mounting a gas washing sink in a centered manner within an opening through a perforated brick in a wall of a metallurgical vessel, to enable gas to be introduced through the sink into molten metal within the vessel, and for removing the sink from the perforated brick, said apparatus comprising:

a support assembly to be fixedly mounted on the exterior of the wall of the metallurgical vessel adjacent the opening in the perforated brick;

fastening means including mounting means for mounting the sink at a position centered relative to said fastening means, said fastening means being mounted with respect to said support assembly for movement relative thereto between an operating position, whereat the sink is pressed into the opening through the perforated brick in a centered manner, and a maintenance position, whereat said fastening means is centered with respect to the opening through the perforated brick and thereby the sink is withdrawn from the opening through the perforated brick;

means, operable between said support assembly and said fastening means, for moving said fastening means and thereby the sink relative to said support assembly to said operating position; and withdrawal means, operable between said support assembly and said fastening means, for moving said fastening means and thereby the sink relative to said support assembly from said operating position to said maintenance position.

2. An apparatus as claimed in claim 1, wherein said support assembly includes at least one column, and said fastening means comprises at least one member movable relative to said column.

3. An apparatus as claimed in claim 2, comprising at least two said columns.

4. An apparatus as claimed in claim 2, including two said columns, and said member comprises a cross member having opposite ends with bores therethrough, said columns extending through respective said bores, and said cross member being slidable in opposite directions relative to said columns.

5. An apparatus as claimed in claim 4, further comprising a closure member supported by said cross member and movable therewith to sealingly press against the sink.

6. An apparatus as claimed in claim 5, further comprising a gas inlet connection connected to said closure member.

7. An apparatus as claimed in claim 5, wherein said closure member includes a seal ring to seal against the sink.

8. An apparatus as claimed in claim 2, wherein said support assembly further includes a pivot axis, and said at least one member comprises a lever assembly pivotable about said axis.

9. An apparatus as claimed in claim 8, further comprising a closure member supported by said lever assembly and movable therewith.

10. An apparatus as claimed in claim 9, further comprising a gas inlet connection connected to said closure member.

11. An apparatus as claimed in claim 9, wherein said mounting means comprises means for connecting said closure member to the sink.

12. An apparatus as claimed in claim 11, wherein said connecting means comprises a centering ring attached to said closure member and having a contact surface to be complementary to the peripheral surface of the sink.

13. An apparatus as claimed in claim 12, further comprising means for detachably connecting said centering ring to said closure member.

14. An apparatus as claimed in claim 8, wherein said lever assembly has a construction such that, upon pivoting thereof about said axis from said operating position to said maintenance position, said lever assembly first moves the sink in an outward direction substantially perpendicular to the plane of the opening in the perforated brick and then in a curved direction.

15. An apparatus as claimed in claim 14, wherein said support assembly further includes a stop for limiting movement of said lever assembly and thereby to define said maintenance position.

16. An apparatus as claimed in claim 1, further comprising a casing removably attachable to said fastening means and having an outer contour corresponding to the outer contour of the sink, whereby said casing is insertable in a centered manner by said fastening means into a worn opening in the perforated brick to thereby form a template defining the contour of the opening in a worn portion of the perforated brick to enable the repair thereof.

* * * * *